US005853097A

United States Patent [19]

Ekkert

[11] Patent Number: 5,853,097

[45] Date of Patent: Dec. 29, 1998

[54] RIBBED CONTAINER CLOSURE

[75] Inventor: Len Ekkert, Lemont, Ill.

[73] Assignee: Phoenix Closures, Inc., Naperville, Ill.

[21] Appl. No.: 891,309

[22] Filed: Jul. 10, 1997

[51] Int. Cl.[6] ..... B65D 41/00

[52] U.S. Cl. ..... 215/295; 215/252; 215/317; 215/329; 215/318

[58] Field of Search ..... 215/252, 295, 215/305, 316–318, 322, 324, 325, 329, 382–384

[56] References Cited

U.S. PATENT DOCUMENTS

| | | |
|---|---|---|
| D. 369,748 | 5/1996 | Zemlo et al. . |
| D. 370,631 | 6/1996 | Zemlo et al. . |
| D. 371,074 | 6/1996 | Zemlo et al. . |
| 3,455,478 | 7/1969 | Fields et al. . |
| 4,156,490 | 5/1979 | Peraboni . |
| 4,343,408 | 8/1982 | Csaszar . |
| 4,352,436 | 10/1982 | Chartier et al. . |
| 4,432,461 | 2/1984 | Mumford et al. . |
| 4,436,212 | 3/1984 | Llera . |
| 4,461,390 | 7/1984 | Csaszar . |
| 4,479,586 | 10/1984 | Csaszar . |
| 4,549,667 | 10/1985 | Dullabaun . |
| 4,567,993 | 2/1986 | Albrecht et al. . |
| 4,613,052 | 9/1986 | Gregory et al. . |
| 4,669,623 | 6/1987 | Csaszar . |
| 4,756,438 | 7/1988 | Ryder . |
| 4,807,771 | 2/1989 | Roy et al. . |
| 4,919,285 | 4/1990 | Roof et al. . |
| 4,978,016 | 12/1990 | Hayes . |
| 5,092,478 | 3/1992 | La Pierre . |
| 5,135,123 | 8/1992 | Nairn et al. . |
| 5,137,163 | 8/1992 | Moore . |

FOREIGN PATENT DOCUMENTS

| | | | |
|---|---|---|---|
| 1361180 | 7/1974 | United Kingdom | 215/252 |

*Primary Examiner*—Stephen K. Cronin
*Assistant Examiner*—Robin A. Hylton
*Attorney, Agent, or Firm*—Welsh & Katz, Ltd.

[57] ABSTRACT

A closure for use with an associated container having a finish with an external securing member formed thereon, includes a closure cap having an enlarged top wall portion defining an outermost edge and an annular skirt portion depending from the top wall portion inwardly of the outermost edge. The skirt portion has an outer wall and an inner wall having an internal securing member engageable with the container external securing member. The closure cap includes a plurality of parallel, spaced apart, tapered ribs. At least some of the ribs extend between the top wall portion and the skirt outer wall. Each rib defines an outer edge and tapers inwardly or thins from the closure cap to the outer edge to define a region adjacent to a juncture of each rib and the closure cap having a cross-sectional area that is greater than a cross-sectional area at the outer edge of each respective rib. The ribs can taper in one or more directions. The ribs are separated from one another by parallel recessed regions.

15 Claims, 3 Drawing Sheets

A
10
12
18
20
24
34
36
40
44
44a
44b
44c
44d
45a
45b
46
47
48
66
68
78
80
82

RIBBED CONTAINER CLOSURE

FIELD OF THE INVENTION

This invention relates to a container closure having a plurality of tapered ribs. More particularly, the invention relates to a container closure having an enlarged top wall and a depending annular skirt, and including a plurality of tapered ribs at least some of which extend between the top wall and the depending skirt.

BACKGROUND OF THE INVENTION

Container closures are common-place in consumer markets. Typically, closures are injection molded from a plastic or like material. Such closures can be used for sealing containers, e.g., bottles of juice, milk, soda pop and the like. One known closure includes a circular top wall portion and an annular skirt depending from the top wall portion. The closure may include tamper indicating means, such as a tamper-indicating band that depends and is separable from the annular skirt.

Generally, closures are formed as snap-type closures or threaded closures. Snap-type closures secure to the container by a one or more inwardly projecting elements that snap over complementary, outwardly projecting elements on the container finish. Threaded closures have a thread formed on an inner surface of the depending skirt that engages a complementary thread formed on the container finish. Threaded closures are more commonly used for containers for liquid storage.

In a typical closure, the skirt depends from a peripheral edge of the top wall portion. Thus, the closure cap defines an inverted cup-like figure that essentially matches the profile of the container neck and finish. Containers can have various sizes of openings and thus various sizes of closure caps. The container opening size may be dependent upon, in part, the liquid stored in the container. For example, some types of liquid foods may be best packaged in a container that has a relatively small dispensing opening that provides for directed pouring, while others liquids, such as milk, juice and the like, that may be consumed directly from the container may be best packaged in containers having a somewhat larger dispensing opening.

Generally, the size of the dispensing opening determines or dictates the physical size of the closure. Moreover, the cost of producing the closure is often directly related to the size thereof because material is generally the largest cost component of the closure. Nevertheless, closures are made in a wide array of sizes, from the smallest closures that may be used on bottles of hot pepper sauce, to the larger closures that may be used for condiments such as mustard, mayonnaise and the like.

Beverages and the like, such as milk, juice and soda pop, that can be consumed directly from the bottle or container, typically have dispensing openings, and thus closures having a diameter of about 1⅛ to about 1½ inches. This size range of dispensing openings and closures is well suited for drinking directly from a container, or for pouring these relatively low viscosity food products from the container into, for example, a drinking glass. However, there are drawbacks to closures associated with these sizes of openings.

It has been observed that, at times, containers can be quite difficult to open. While this may be desirable for medicine containers, it is undesirable for food storage containers and the like. Difficulty in opening can be due, in part, to the relatively small size of the closure cap. Such small sized closures can be difficult to grip, and may require considerable torque or force to remove them from their associated containers. Moreover, accumulated food product around the container neck can oxidize and harden, adhering the cap to the container, thus creating even greater difficulty in removing the cap.

It has also been observed that certain products can be stored, shipped or merchandized with their containers stacked one on top of another. For example, it is not uncommon for milk to be packaged and shipped in crates that have containers stacked two or more high to economize the shipping process.

Known packaging configurations, and more particularly, known closure caps are not well suited for such stacking arrangements. Specifically, known closures generally have a diameter that is too small to permit stacking containers one on top of another. Because the closures have diameters between about 1⅛ and 1½ inches, the containers do not properly stack and are prone to shift, tip or fall.

Accordingly, there continues to be a need for a closure having a top with a relatively large surface area, which surface area is independent of the size of the neck and opening of the associated closure. Such a closure facilitates a user's removing the closure from the container by increasing the torque or force that can be applied thereto. The closure further permits the containers used therewith to be stacked on one another for shipping, storage and merchandizing the product. Such a closure is readily molded from plastic or like material in an injection molding process and is cost effective relative to like closures.

SUMMARY OF THE INVENTION

A closure for use with an associated container is disclosed. The container has a finish with an external securing member formed thereon, the securing member can be a snap-type engaging element or a thread for securing the closure to the container.

The closure includes a cap having an enlarged top wall portion defining an outermost edge. An annular skirt depends from the top wall portion inwardly of the outermost edge. The skirt has an outer wall and an inner wall having an internal securing member engageable with the container external securing member. The closure cap includes a plurality of tapered ribs, at least some of which extend between the top wall portion and the skirt outer wall. Each rib defines an outer edge, and tapers inwardly, i.e., thins, from the skirt to the outer edge to define a region adjacent to a juncture of each rib and the skirt having a cross-sectional area that is greater than a cross-sectional area at the outer edge of each respective rib.

Advantageously, the present closure includes a top wall that is enlarged and defines a substantially planar surface having a larger surface area than known closures of a specific size. The planar surface is well suited for stacking containers one on top of another. The larger surface area provides more stability to such a stacked arrangement of containers, reducing the tendency of the stack to tilt, shift or fall.

Moreover, the enlarged top wall and tapered ribs facilitate removing the closure from a container. The ribbed configuration permits readily grasping the closure to remove it from the container. To effect ready removal of the closure, the enlarged top wall, in conjunction with the ribbed configuration, enables a user to produce more torque or force on the closure to remove it from the container. In a preferred embodiment, the ribs have a curved or arcuate shape, curving downwardly and inwardly toward the skirt, to comfortably fit into a user's hand.

Advantageously, the ribbed configuration also reduces the amount of material required to manufacture the closure and thus reduces the overall weight and the material cost of the closure. The tapered rib arrangement also facilitates manufacture of the closure. Specifically, the tapered ribs facilitate separating the closure from the closure mold to eject or remove the closure from the molding apparatus.

The ribs can taper in one direction, such as axially, downwardly from the top wall. Preferably, the ribs taper in at least two directions, e.g., axially, downwardly from the top wall, and radially, inwardly from the skirt portion. In a most preferred embodiment, the ribs are parallel to one another.

In one embodiment, the top wall defines a peripheral edge and the skirt portion depends from the top wall inwardly of the peripheral edge. The top wall defines an extension region or overhang region between the skirt wall and the peripheral edge. Preferably, at least some of the ribs extend from the extension region to the skirt wall, and have a greatest cross section at the skirt wall/rib and top wall/rib junctures. The ribs taper downwardly, in an axial direction, at an angle of, for example, about 4°.

The closure may include a tamper-indicating band depending from the closure cap. The band can be connected to the closure cap by a plurality of frangible connectors. The connectors can extend between the tamper-indicting band and at least some of the ribs.

Other features and advantages of the present invention will be apparent from the following detailed description, the accompanying drawings, and the appended claims.

DETAILED DESCRIPTION OF THE PREFERRED EMBODIMENTS

Figures 1, 2, 3:
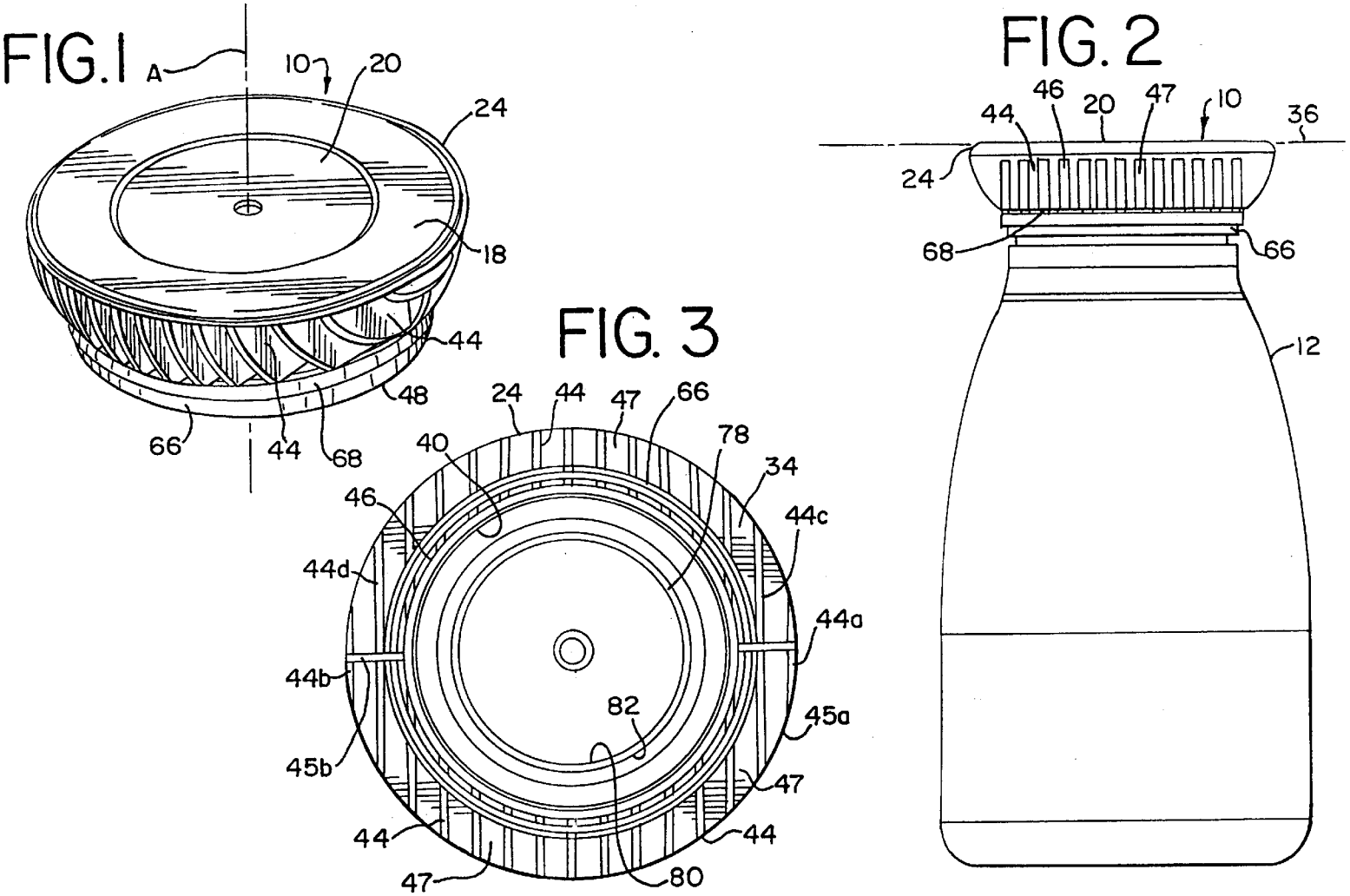
FIG. 1 is a perspective view of a closure having an enlarged top wall and a plurality of tapered ribs, at least some of which extend between the top wall and the closure skirt, in accordance with the principles of the present invention, the closure being shown with an optional tamper-indicating band.
FIG. 2 is side view of the closure of FIG. 1, the closure being illustrated engaged with an associated container.
FIG. 3 is a bottom view of the closure of the FIG. 1.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 9:
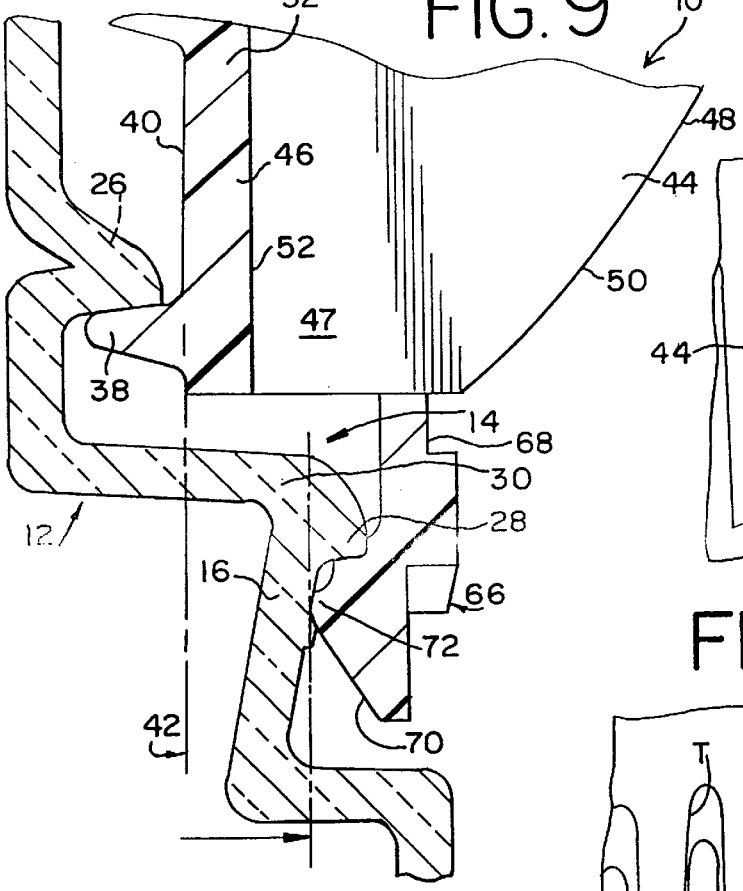
FIG. 9 is a partial cross-sectional view of the closure, with the closure threadedly engaged with a container, and illustrating the optional tamper-indicating band connected to a rib, the band being shown engaged with a portion of the container neck.

Referring now to the figures, and in particular to FIG. 1, there is shown a closure 10 in accordance with the principles of the present invention. The closure 10 is illustrated engaged with a container 12 that may contain, for example, milk. Referring now to FIG. 9, which illustrates the closure 10 and a portion of the container 12 with which the closure 10 is engaged, the container 12 includes a finish portion 14 which is that portion of the container neck 16 that engages the closure 10.

The present closure 10 can be used with different types of containers, such as threaded containers and snap-type containers. It is to be understood that while the following description is directed to a closure 10 that is used with a threaded container, it is one illustration of a closure that includes tapered ribs. The following description of the closure 10 is not intended to limit the scope of the invention to such a closure 10. Rather, the invention is to be considered applicable to all closures, commensurate with the scope of the appended claims.

The closure 10 includes a cap 18 having a top wall portion 20 and an annular skirt portion 22 depending from the top wall portion 20. The top wall portion 20 is generally circular, and is integral with the skirt portion 22. The closure 10 is illustrated with an over-sized or enlarged top wall 20. The top wall 20 defines an outermost 24 edge at the periphery thereof.

When used with a threaded type closure 10, the associated container 12 has a finish 14 that includes a thread formation 26 thereon and a locking or interference ring 28 disposed on the container 12, below the container threads 26. As illustrated, the locking ring 28 can extend from a shoulder 30 formed in the container 12 below the threads 26.

Figures 4, 5, 6, 7, 8:
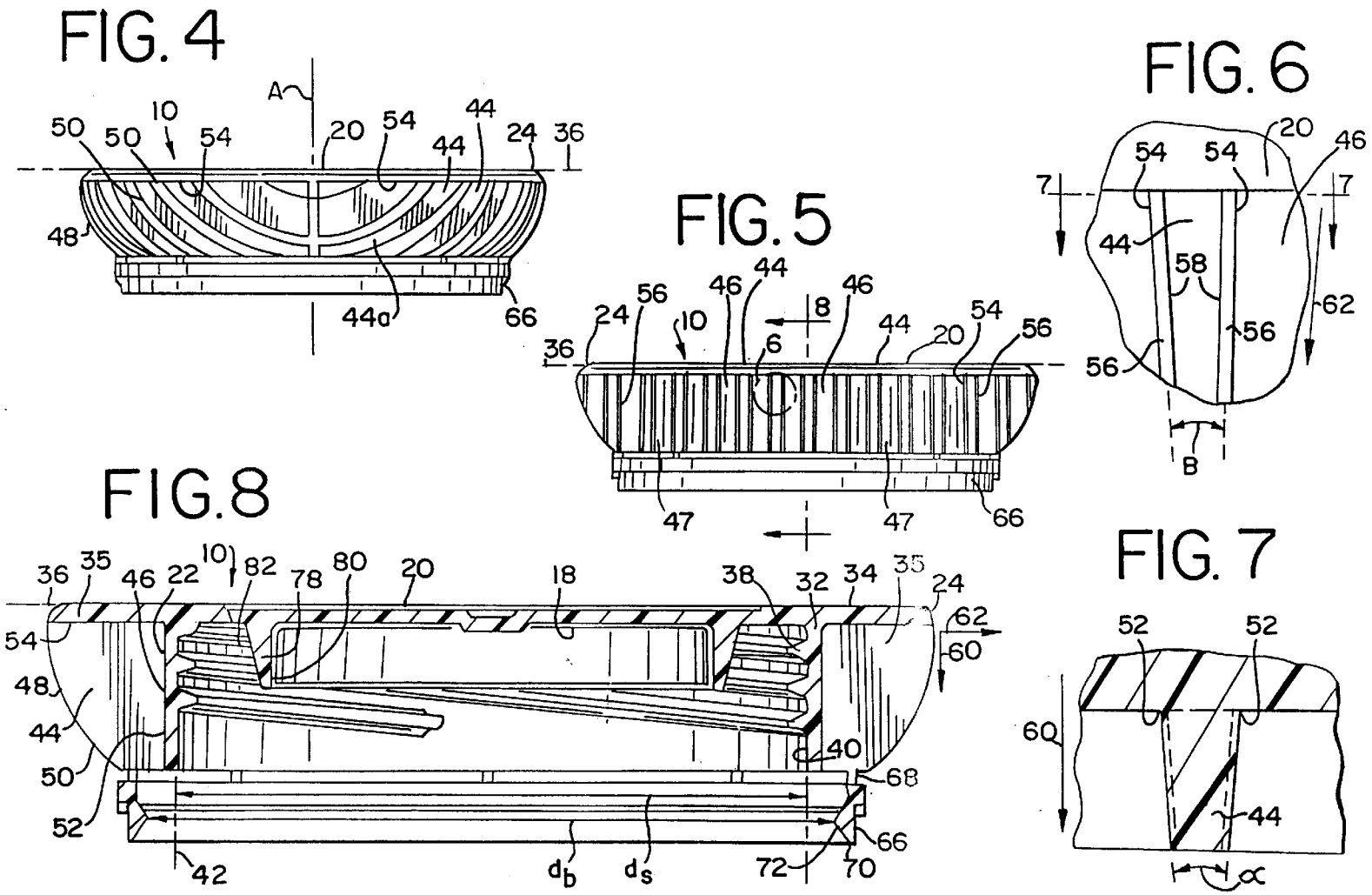
FIG. 4 is a side view of the closure of FIG. 1, as viewed from the right-hand side thereof.
FIG. 5 is a side view of the closure of FIG. 1, as viewed from the left-hand side thereof.
FIG. 6 is an enlarged view of a portion of the closure as indicated in FIG. 5, illustrating one tapered rib extending between the top wall and the skirt.
FIG. 7 is a cross-sectional view of the rib taken along line 7—7 of FIG. 6.
FIG. 8 is a cross-sectional view of the closure taken along line 8—8 of FIG. 5.

Referring to FIG. 8, which illustrates the exemplary closure 10, the depending skirt portion 22 depends from the top wall portion 20 inwardly of the outermost edge 24. A portion of the top wall 20 outward of the top wall/skirt juncture, as illustrated at 32, defines a top wall extension region 34 and an overhang region 35. As will be readily apparent from the figures, the top wall 20 including the extension region 34, defines a substantially planar surface, as indicated at 36, having a larger surface area than known closures of a specific size. The planar surface 36 is well suited for stacking containers 12 one on top of another. The relatively large planar surface 36 provides more stability to such a stacked arrangement of containers, reducing the tendency of the stack to tilt, shift or fall.

The skirt portion 22 includes an internal thread 38 formed in an inner wall 40 thereof for engaging the container threads 26. It will be understood by those skilled in the art that closures configured for use with snap-type containers may not include such an internal thread formation. Rather, closures using snap-type arrangements may include inwardly oriented projections configured to engage complementary projections or rings on the container finish.

Referring to FIG. 9, the inner wall of the skirt 40, from which the thread formation 38 extends, defines a skirt wall plane as indicated at 42. The plane 42 extends generally perpendicular to the cap top wall 20.

The cap 18 includes a plurality of tapered fin-like elements or tapered ribs 44, at least some of which extend within the overhang 35, between the top wall portion 20, at about the extension region 34, and an outer wall 46 of the depending skirt 22. The ribs 44 facilitate, in part, readily grasping the closure 10 for removing the closure 10 from the container 12. Preferably, the ribs 44 have a curved or arcuate shape, as indicated at 48, curving downwardly and inwardly toward the skirt 22, to comfortably fit into a user's hand. As will be apparent from the figures, the ribs 44 are separated from one another by parallel recessed regions 47 that extend between each rib 44 and its adjacent ribs 44. Preferably, the recessed regions 47 extend to the skirt outer wall 46.

In addition, the enlarged top wall 20, in conjunction with the ribbed 44 configuration, enables a user to produce more torque or force on the closure 10 to remove it from the container 12. In this manner, the above-noted problems associated with caps that have adhered to the container due to oxidized food product are readily overcome. Advantageously, the ribbed 44 configuration also reduces the amount of material required to manufacture the closure 10, and thus reduces, the overall weight and material cost of the closure 10.

In a current embodiment, the closure 10 includes about 30 ribs 44 that are parallel to one another. It will be recognized by those skilled in the art that the closure 10 can include any number of ribs 44, and that the ribs 44 can have various shapes, sizes and orientations, which various shapes, sizes and orientations are within the scope of the present invention.

Referring to FIG. 3, in one embodiment, the closure 10 includes a pair of end ribs 44*a,b* that are the outermost ribs 44, and depend from the top wall 20 in opposing relation to one another, that is, 180° from one another. The closure can include gussets 45*a,b* that extend from the top wall 20 between about the midpoint of the end ribs 44*a,b* and their respective next adjacent ribs 44*c,d*. The gussets 45*a,b* provide additional support for the end ribs 44*a,b*. In addition, the gussets 45*a,b* provide a more substantial appearance for the closure 10. That is, when viewed from the side as shown in FIG. 5, the closure 10 has the appearance of a solid member, rather than having the end ribs 44*a,b* and possibly the next adjacent ribs 44*c,d* appear to extend and cantilever from the cap 18.

Referring now to FIG. 8, the ribs 44 extend between the outer wall 46 of the skirt 22 and the top wall 20. In a preferred embodiment, the ribs 44 extend between the skirt 22 and the extension region 34 of the top wall 20, within the overhang 35, and define an outer edge 50 at a periphery thereof. Referring to FIGS. 5–7, the ribs 44 of the present closure 10 taper or thin as they extend from the skirt 22 and the top wall 20 to the outer edge 50. That is, the ribs 44 have a cross-sectional area at a juncture with the closure 10, (as indicated at 52 for the rib/skirt juncture and as indicated at 54 for the rib/top wall juncture), that is greater than a cross-sectional area of the ribs 44 at the outer edge, as indicated at 50.

Referring to FIG. 7, the cross-sectional area at the rib/top wall juncture 54 is indicated by the entire cross-hatched area, whereas the cross-sectional area of the rib 50 as it tapers, as it extends away from the rib/top wall juncture 54 is indicated by the area inside of the dashed lines within the cross-hatched area. Likewise, referring to FIG. 6, the cross-sectional area of the rib 44 at the rib/skirt juncture 52 is shown by the larger of the downwardly tapering areas, namely, the area between the lines indicated at 56, whereas the cross-sectional area of the rib 44 as it extends away from the rib/skirt juncture 52 is shown by the area between the lines indicated at 58.

The ribs 44 can taper in one direction, either axially or radially, as indicated at 60 or 62, relative to an axis A through the center of the closure 10, shown in FIGS. 4 and 6–7. Alternately, the ribs 44 can taper in more than one direction, such as both the axial and radial directions 60, 62, as shown. That is, the ribs 44 can taper or thin in more than one direction as they extend between the top wall 20 and the outer edge 50 and the skirt 22 and the outer edge 50.

Advantageously, the tapered ribs 44 facilitate manufacture, and more specifically, molding of the closure 10 and subsequent release or ejection of the closure 10 from the mold. Those skilled in the art will recognize that in an injection molding process, the molded part is created by filling the voids of the mold with, for example, a plastic. After the item is molded, the mold portions must be separated from one another to remove or eject the molded part. The present tapered ribs 44 facilitate ejecting the closure 10 from the mold.

Figure 10A:
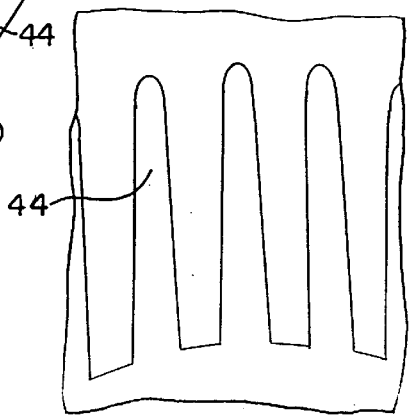
FIGS. 10A and 10B illustrate the forming of the tapered ribs in the closure mold and separation of the ribs from the mold.
Figure 10B:
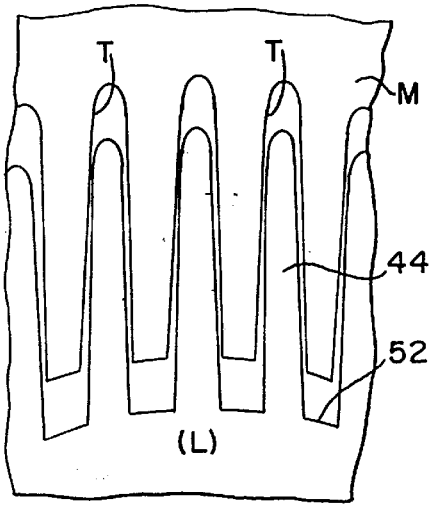

Referring to FIGS. 10A and 10B, which illustrate the non-contacting nature of the mold M separation, the tapers T of the mold M are complementary to the tapers of the ribs 44. That is, where the ribs 44 are closest to one another (for example, at the rib/skirt juncture 52), the mold M portions are spaced furthest from one another. Because the mold M portions are complementary to the ribs 44, they are largest at about the location of contact with the outer edge 50 of the ribs 44.

In FIG. 10A, the mold M is illustrated with the ribs 44 formed around the mold M surfaces. The ribs 44 are shown with a radial taper. As the mold M is separated, as illustrated in FIG. 10B, the mold M is urged away from the ribs 44 without contact, or with minimal contact between the mold M and the ribs 44. Although the illustrations of FIGS. 10A and B are simplified, they provide an understanding of one advantage that the present tapered ribs 44 provide over known closure arrangements, and the manufacturing thereof.

The ribs 44 can taper radially, as indicated at 62, as provided above. The ribs 44 can also taper axially, downwardly, as indicated at 60, from the top wall 20 to the end of the closure 10. This configuration further facilitates ejection or release of the closure 10 from the mold M. In a current embodiment, the ribs 44 taper in both the axial direction as indicated at 60, at an angle $\alpha$ of about 4°, and in the radial direction, as indicated at 62, at an angle $\beta$ of about 4°. It is to be understood that the ribs 44 can taper at different angles in the axial and radial directions 60, 62, which different angles $\alpha$, $\beta$ of tapers are within the scope of the present invention.

While the present invention is not to be limited to the following description of the closure 10, referring to FIGS. 8 and 9, the closure 10 may include a tamper-evident or tamper-indicating band 66 that depends from the cap 18. The band 66 is configured to provide visibly discernible evidence that the closure 10 has been removed from the container 12, that the container 12 may have been opened or that the contents may have been otherwise tampered with.

The tamper-indicating band 66 depends from the cap 18 and is connected thereto by a plurality of circumferentially spaced, tapered, bridge-like connectors 68. The connectors 68 have a predetermined length, and extend between the band 66 and the cap 18. In a preferred embodiment of the closure 10 that includes the band 66, the connectors 68 extend between the band 66 and at least some of the ribs 44. The connectors 68 may be connected to the ribs 44 and to the band 66 at angle such that the band 66 lies generally parallel to the skirt wall plane 42. It will be readily recognized from the figures that in this configuration, the angle formed between the connectors 68 and the ribs 44 is equal to the angle formed between the connectors 68 and the band 66.

The connectors 68, which are substantially thinner than the band 66 adjacent thereto, are frangible connections that break or yield as the closure 10 is threadedly or otherwise disengaged from the container 12 and as the band 66 is urged outwardly and downwardly from the closure 10.

As best seen in FIG. 9, the band 66 can be connected to the cap 18 such that the entirety of the band 66 depends from the ribs 44 and is outwardly displaced from the skirt wall plane 42. Essentially, the band 66 lies in a different plane than, and is thus non-coplanar with the skirt wall plane 42. As provided above, the connectors 68 may be formed at an angle of, for example, about 7° relative to the skirt wall plane 42, which connectors 68 are then formed at an angle of about 7° relative to the band 66 plane.

The radially spaced relationship between the band 66 and the skirt 22 provides a number of advantages. For example, when the closure 10 is initially engaged with the container 12, the band 66 does not contact, or minimally contacts, the container threads 26, thus reducing the opportunity for inadvertently breaking any of the connectors 68 during initial engagement of the closure 10 and the container 12. In addition, the spaced relationship between the skirt wall plane 42 and the band 66 minimizes the dependence of band 66 design on the skirt wall plane 42, skirt diameter $d_s$ and skirt 22 design. With the band 66 configuration minimally dependent upon the skirt wall diameter $d_s$, more efficient, less breakage prone connectors 68 can be used.

The illustrated tamper-evident band 66 permits initial placement of the closure 10 onto the container 12, while reducing or eliminating the possibility that one or more of the connectors 68 will break, and that the band 66 will separate from the cap 18 as the closure 10 is applied to the container 12. The band 66 is further adapted to facilitate separation of the band 66 from the skirt 22 as the closure 10 is removed from the container 12, to provide tamper indication.

The band can include an inclined or ramped surface 70 extending from about an end of the band 66, upward, to facilitate initial placement of the closure 10 on the container 12 so that the band 66 properly engages the locking ring 28. The band 66 can also include one or more projections or peaks 72 extending inwardly thereof. The projections 72 engage the locking ring 28 and provide sufficient resistance as the closure 10 is removed from the container 12 so that the band 66 separates from the closure 10 upon removal of the closure 10 from the container 12.

As will be apparent from the figures, as the closure 10 is applied to the container 12, the band 66 readily passes over the container threads 26 with minimal, if any contact therebetween. The closure threads 38 are engaged with the container threads 26 while the band 66 slides down and over the locking ring 28, as illustrated in FIG. 9. The closure 10 is then fully applied to the container 12, and the band 66 comes to rest at about the interference ring 28.

When it is desired to access the contents of the 12 container and to remove the closure 10, the closure 10 is grasped about the top wall 20 and ribs 44, and the closure 10 is urged off of the container 12. In an arrangement in which the container 12 and closure 10 include respective, complementary threads, 26, 38, as twisting torque is applied to remove the cap 18, the band 66 contacts and engages the interference ring 28, which urges the band 66 outward, creating a tearing or severing force on each of the connectors 68, breaking the connectors 68. The tearing force is a result of the cap 18 being forced upward relative to the container 12, while the band 66 is obstructed from upward movement due to the contact between the interference ring 28 and the one or more projection 72.

In an arrangement in which the container 12 and closure 10 use a snap-type securing configuration, a similar interaction between the band 66 and the interference ring 28 occurs. That is, as the closure 10 is urged upward, off of the container 12, the band 66 contacts the interference ring 28, which obstructs upward movement of the band 66, resulting in breaking or fracturing the connectors 68.

As is best seen in FIG. 8, the closure 10 may include a plug 78 that depends from the top wall 20, annularly disposed relative to the skirt 22. The plug 78 has an inner surface 80 and an outer surface 82. The outer surface 82 is configured to engage the container neck 16 at about the inner surface thereof, such that the container neck 16 is positioned between the plug 78 and the skirt 22 when the closure 10 is engaged with the container 12. The plug 78 enhances the seal between the container contents and the environs.

Figure 11:
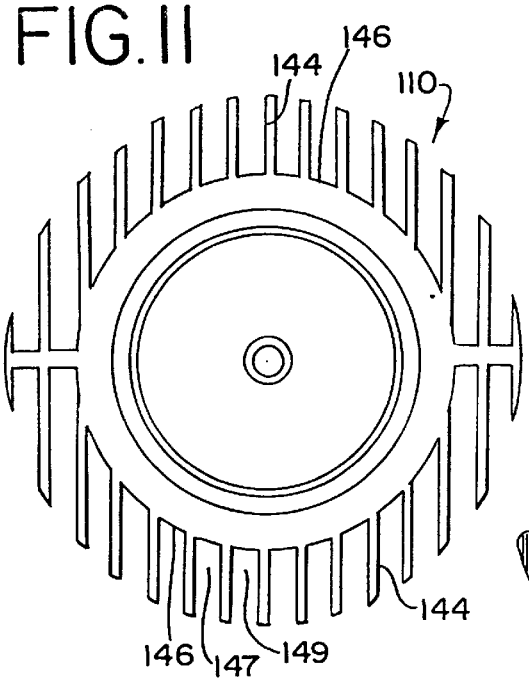
FIG. 11 is a top view of an alternate embodiment of the closure with tapered ribs, the closure having open, recessed areas between the ribs that extend into the top wall of the closure.
Figure 12:
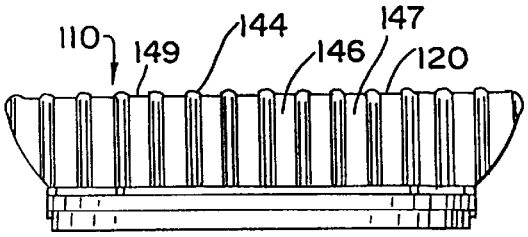
FIG. 12 is a side view of the closure of FIG. 11.

An alternate embodiment of the closure 110 is illustrated in FIGS. 11 and 12. In this embodiment, the ribs 144 extend outwardly from the skirt wall 146. The ribs 144 extend to, and form a portion of the top wall 120. Essentially, the recessed regions 147 extend upwardly, into the top wall 120 and form notches 149 in the top wall 120 that correspond to the recessed regions 147 between the ribs 144. All of the other portions of the closure 10, as well as the advantageous characteristics thereof, are similar to the embodiment of the closure 10 described above.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A closure for use with an associated container, the container having a finish with an external securing member formed thereon, the closure comprising:

a closure cap having an enlarged top wall portion defining an outermost edge and an annular skirt portion depending from said top wall portion inwardly of said outermost edge, said skirt portion having an outer wall and an inner wall having an internal securing member engageable with the container external securing member, said closure cap including a plurality of parallel tapered ribs, at least some of said ribs extending between said top wall portion and said skirt outer wall, each said rib defining an outer edge, wherein said ribs taper so as to define a region adjacent to a juncture of each said rib and said closure cap having a cross-sectional area that is greater than a respective cross-sectional area at said outer edge thereof.

2. The closure in accordance with claim 1, wherein said ribs taper in at least one direction.

3. The closure in accordance with claim 2, wherein said ribs taper in two directions.

4. The closure in accordance with claim 1, wherein said top wall defines a peripheral edge and wherein said skirt portion depends from said top wall inwardly of said peripheral edge to define an extension region therebetween.

5. The closure in accordance with claim 4 wherein said ribs extend from said closure at said extension region.

6. The closure in accordance with claim 1, wherein said ribs have an arcuate shape.

7. The closure in accordance with claim 1, wherein said ribs taper downwardly, in an axial direction, at an angle of about 4°.

8. The closure in accordance with claim 1 including a tamper-indicating band depending from said closure cap.

9. The closure in accordance with claim 8 wherein said tamper-indicating band is connected to said closure cap by a plurality of frangible connectors.

10. The closure in accordance with claim 9 wherein said connectors extend between said tamper-indicting band and at least some of said ribs.

11. A closure for use with an associated container, the container having a finish including an external securing member, the closure comprising:

a closure cap having an enlarged top wall portion defining an outer edge and a depending skirt portion depending from said top wall portion inwardly of said outer edge defining an overhang region, said cap including a plurality of parallel, spaced, tapered ribs depending from said top wall portion within said overhang region, at least some of said ribs extending outwardly from said skirt portion, said outwardly extending ribs being spaced from one another by a plurality of parallel recessed regions between each rib and ribs adjacent thereto, each of said outwardly extending ribs defining an outer edge and tapering to said outer edge to define a cross-sectional area at said skirt that is greater than a respective cross-sectional area at said outer edge thereof.

12. The closure in accordance with claim 11 wherein said top wall defines a plurality of notches therein each said notch corresponding with a respective recessed area between adjacent ribs.

13. The closure in accordance with claim 11 including about 30 ribs.

14. The closure in accordance with claim 11 wherein the ribs are arcuate.

15. The closure in accordance with claim 11 including a pair of end ribs depending from said top wall and positioned 180° relative to one another and including a gusset extending from about a mid point of each said rib and extending radially between each said end ribs and respective adjacent ribs.

* * * * *